US006718929B2

(12) United States Patent
Onozawa et al.

(10) Patent No.: US 6,718,929 B2
(45) Date of Patent: Apr. 13, 2004

(54) STARTING METHOD FOR INTERNAL COMBUSTION ENGINE AND STARTING DEVICE FOR THE SAME

(75) Inventors: Seiji Onozawa, Saitama (JP); Atsushi Ogasawara, Saitama (JP); Kuniaki Ikui, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/199,098

(22) Filed: Jul. 22, 2002

(65) Prior Publication Data

US 2003/0019455 A1 Jan. 30, 2003

(30) Foreign Application Priority Data

Jul. 25, 2001 (JP) ..... 2001-224282

(51) Int. Cl.[7] ..... F01L 13/08
(52) U.S. Cl. ..... 123/182.1
(58) Field of Search ..... 123/182.1, 90.16, 123/90.17, 179.25

(56) References Cited

U.S. PATENT DOCUMENTS 4,790,271 A * 12/1988 Onda ..... 123/182.1
5,687,682 A * 11/1997 Rembold et al. ..... 123/179.3
6,435,151 B1 * 8/2002 Yamaura et al. ..... 123/182.1

FOREIGN PATENT DOCUMENTS

JP 6-70366 B2 9/1994

* cited by examiner

*Primary Examiner*—Henry C. Yuen
*Assistant Examiner*—Arnold Castro
(74) *Attorney, Agent, or Firm*—Birch, Stewart, Kolasch & Brich, LLP

(57) ABSTRACT

In an internal combustion engine provided with a decompression mechanism, a decompression cam that is rotatable with respect to a camshaft between first and second stop positions has a cam profile so that an exhaust valve is opened at the first stop position and is closed at the second stop position. The decompression cam is rotated in the reverse direction to the first stop position by rotating a crankshaft in the reverse direction by an electric motor at startup (position P1). Only the crankshaft is then rotated in the reverse direction (position p3), and the decompression cam is rotated in the normal direction by rotating the crankshaft in the normal direction by the electric motor. During either a compression strokes included within a range of a reverse rotation angle or the first compression stroke after initiation of normal rotation of the decompression cam until the decompression cam reaches the second stop position, the decompression cam opens the exhaust valve and increases the run-up angle of the crankshaft. The aforementioned method and device facilitates a piston overcoming the first compression top dead center decompression operation has stopped without unduly increasing the size and capacity of the required electric motor.

18 Claims, 12 Drawing Sheets

STARTING METHOD FOR INTERNAL COMBUSTION ENGINE AND STARTING DEVICE FOR THE SAME

BACKGROUND OF THE INVENTION

CROSS-REFERENCES TO RELATED APPLICATIONS

This nonprovisional application claims priority under 35 U.S.C. §119(a) on Patent Application No. 2001-224282 filed in Japan on Jul. 25, 2001, the entirety of which is herein incorporated by reference.

FIELD OF THE INVENTION

The present invention relates to a starting device and a method for starting an internal combustion engine provided with a crankshaft to be rotated by an electric motor at startup with the starting device, and more particularly to a starting device having an electric motor and a decompression mechanism for opening an engine valve which is lifted by a prescribed amount to reduce the compression pressure during the compression stroke of the internal combustion engine.

DESCRIPTION OF THE BACKGROUND ART

Internal combustion engines having a crankshaft rotated by a starter motor during startup are well known. The internal combustion engine having a decompression mechanism for opening the engine valve to be opened and closed by a valve train cam provided on the camshaft that is rotated synchronously with the rotation of the crankshaft is also known.

For example, in Japanese Patent Document 70366/1994, a decompression unit having a decompression cam and a reversing decompression cam supported on the camshaft via a one-way clutch is described. In the case where a piston in the compression stroke is moved slightly backward by the compression pressure when the internal combustion engine is stopped, the camshaft rotates in the reverse direction. The reversing decompression cam rotates integrally with the camshaft by action of the one-way clutch and opens an exhaust valve to decrease the compression pressure in a combustion chamber at the next startup of the engine.

When reverse rotation of the camshaft does not occur when the internal combustion engine is stopped, e.g., when the piston is in the expansion stroke, the decompression cam opens the exhaust valve during the compression stroke after the next startup timing to reduce the compression pressure in the combustion chamber. With such a decompression unit, decompression operation for reducing the compression pressure is performed only in the first compression stroke after startup.

SUMMARY OF THE INVENTION

The present inventors have determined that the background art suffers from the following disadvantages. During startup of an internal combustion engine, the camshaft starts to rotate in the normal direction from a position where the camshaft stopped previously in the decompression unit of the background art. The crank angle from the position when the crankshaft starts to rotate in the normal direction to the point where the first compression stroke starts after stoppage of decompression operation (compression bottom dead center) (hereinafter referred to as "run-up angle") is determined by the position where the camshaft stops when the internal combustion engine is stopped. Therefore, depending on the stopped positions, a sufficient run-up angle may not be secured.

Accordingly, the revolving speed (angular speed) of the crankshaft is not sufficient for the piston to get over the first compression top dead center after cease of decompression operation, thereby hindering smooth starting. Such a circumstance tends to occur especially when the sliding friction of the internal combustion engine is excessive, e.g., for example, in case of low temperature starts or the like.

Therefore, in order to ensure that the piston can get over the first compression top dead center, the generated driving torque must be increased in the case where the starter motor is used for starting the internal combustion engine. Accordingly, the starter motor may have to be upsized disadvantageously. In addition, with the decompression units in the background art, it is difficult to increase the run-up angle significantly because the decompression operation is performed only during the first compression stroke after startup. The present invention overcomes these shortcomings associated with the background art and achieves other advantages not realized by the background art.

An object of the present invention is to provide a starting method and starting device for an internal combustion engine in which the run-up angle is increased so that the piston can easily overcome the first compression top dead center, e.g., particularly after decompression operations at startup have stopped, without increasing the size and capacity of the electric motor and/or starting device for rotating the crankshaft.

These and other objects are accomplished by a starting method for an internal combustion engine comprising the steps of rotating a crankshaft with an electric motor during an engine startup; opening an engine valve which is opened and closed by a valve train cam by a decompression mechanism, wherein the valve train cam is provided on a camshaft that is rotated synchronously with a rotation of the crankshaft, wherein the decompression mechanism includes a decompression cam provided on the camshaft in such a manner that the decompression cam is capable of rotating in the rotational range of the camshaft between a first stop position of the camshaft in a reverse rotational direction and a second stop position of the camshaft in a normal rotational direction and has a cam profile to bring the engine valve into an opened state at the first stop position and into a closed state at the second stop position; rotating the crankshaft in the reverse direction with the electric motor to rotate the decompression cam in the reverse direction to place the decompression cam in the first stop position at startup; rotating the crankshaft in the normal rotational direction with the electric motor to rotate the decompression cam in the normal rotational direction; and opening the engine valve by the decompression cam during either a compression stroke included within the range of a prescribed crank angle in which the crankshaft is rotated in the reverse direction by the electric motor or included within the range within a first compression stroke after a start of normal rotation of the decompression cam, or during the time period until the decompression cam reaches the second stop position.

These and other objects are further accomplished by a starting method for an internal combustion engine comprising the steps of rotating a crankshaft with an electric motor during an engine startup; opening an engine valve which is opened and closed by a valve train cam by a decompression mechanism, wherein the valve train cam is provided on a camshaft that is rotated synchronously with a rotation of the crankshaft, wherein the decompression mechanism includes a decompression cam provided on the camshaft in such a manner that the decompression cam is capable of rotating in the rotational range of the camshaft between a first stop position of the camshaft in a reverse rotational direction and a second stop position of the camshaft in a normal rotational direction and has a cam profile to bring the engine valve into an opened state at the first stop position and into a closed state at the second stop position; rotating the crankshaft in the reverse rotational direction with the electric motor to rotate the decompression cam in the reverse direction to place the decompression cam in the first stop position at startup; rotating the crankshaft in the normal rotational direction with the electric motor to rotate the decompression cam in the normal direction; and opening the engine valve with the decompression cam at a plurality of compression strokes during a period until the decompression cam reaches the second stop position.

These and other objects are further accomplished by a starting device for an internal combustion engine, wherein the starting device includes an electric motor for rotating a crankshaft during an engine startup, an engine valve with a valve train cam, a control device for controlling rotation of the crankshaft with the electric motor, and a decompression mechanism for opening the engine valve to be opened and closed by the valve train cam provided on a camshaft that is rotated synchronously with rotation of the crankshaft, the decompression mechanism comprising a reverse rotation stopper defining a first stop position; a normal rotation stopper defining a second stop position; a decompression cam rotatably mounted on the camshaft so as to be capable of rotating in a rotational range of the camshaft between the first stop position in a reverse rotational direction of the camshaft and the second stop position in a normal rotational direction of the camshaft; a decompression cam profile for opening the engine valve at the first stop position and closing the same at the second stop position; a torque transmission device transmitting reverse rotation torque from the camshaft to the decompression cam, the torque transmission device including a constrained state in which relative rotation between the camshaft and the decompression cam is constrained during a reverse rotation of the crankshaft, and an unconstrained state in which a drag torque is transmitted in the normal direction from the camshaft to the decompression cam by permitting a relative rotation between the camshaft and the decompression cam during a normal rotation of the crankshaft; and a rotation control device alternately preventing and permitting dragging of the decompression cam between the first stop position and the second stop position in the normal rotational direction.

According to a first aspect of the present invention, the crankshaft is rotated in the reverse direction by a prescribed crank angle by the electric motor and thus the decompression cam is rotated in the reverse direction and then in the normal direction at startup. When the crankshaft is rotated in the reverse direction, the engine valve is opened by rotating the decompression cam in the reverse direction and placing the same at the first stop position. Next, the decompression cam is rotated in the normal direction after the crankshaft starts to rotate in the normal direction. Then, decompression operation is performed during the compression stroke, e.g., either the compression stroke included in the range of the prescribed crank angle by which the crankshaft is rotated in the reverse direction or the first compression stroke after normal rotation of the decompression cam during the time period until the decompression cam reaches the second stop position.

Accordingly, the run-up angle increases by the extent of the prescribed crank angle by which the crankshaft is rotated in the reverse direction from the rotational position of the crankshaft at startup of the internal combustion engine. The revolving speed of the crankshaft at the first point of start of compression after stoppage of decompression operation thus increases, and the piston can easily overcome the first compression top dead center after stoppage of decompression operation. Therefore, the starting capability of the engine is improved without unnecessarily increasing the size and capacity of the electric motor that rotates the crankshaft. In addition, since the engine valve can always be opened at a certain position of the decompression cam when the crankshaft rotates in the normal direction by positioning, the angular range in which the engine valve can be opened by the decompression cam can be set to a certain range at each startup, thereby ensuring larger run-up angle than the related art.

According to a second aspect of the present invention, the crankshaft is rotated in the reverse direction by a prescribed crank angle by the electric motor and the decompression cam is rotated in the reverse direction and then in the normal direction at startup. Therefore, when the crankshaft is rotated in the reverse direction, the engine valve is opened by the decompression cam by rotating the decompression cam in the reverse direction and placing the decompression cam at the first stop position. The decompression cam is then rotated in the normal direction after the crankshaft starts to rotate in the normal direction. Decompression operation is then performed during a plurality of compression strokes until the decompression cam reaches the second stop position by rotating in the normal direction. Accordingly, decompression operation is performed during at least two compression strokes after the crankshaft starts rotating in the normal direction, and thus the run-up angle increases.

According to an additional aspect of the present invention, the following effects are exercised in addition to the effects described hereinabove. The torque transmission device includes the one-way clutch and the torque limiter provided in series in the torque transmission route from the camshaft to the decompression cam. When the crankshaft is further rotated in the reverse direction during which relative rotation between the camshaft and the decompression cam is disabled by the effect of the one-way clutch, the decompression cam abuts against the reverse rotation stopper and stopped at the first stop position by the torque limiter in a simple structure. The run-up angle increases correspondingly, and thus the revolving speed of the crankshaft at the first point of start of compression after stoppage of decompression operation increases. Accordingly, the piston can overcome the first compression top dead center after stoppage of decompression operation more easily. In addition, the torque limiter can prevent excessive torque from exerting on the decompression cam, the reverse rotation stopper, and the one-way clutch.

According to an additional aspect of the present invention, since the effective operation angle of the decompression cam is larger than the operation angle of the valve train cam which opens and closes the engine valve during the time that the valve is opened by the decompression cam at startup, decompression operation is not stopped by the first opening of the engine valve by the valve train cam after normal rotation has started. Instead, it is stopped at subsequent openings of the engine valve by the valve train cam. Accordingly, the advantageous effects of the present invention are obtained with a relatively simple structure depending on the configuration of the profile of the decompression cam. In the following description of the present invention, the various angles of operation and various angles are meant to be associated with the rotational angles of the crankshaft where otherwise not noted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
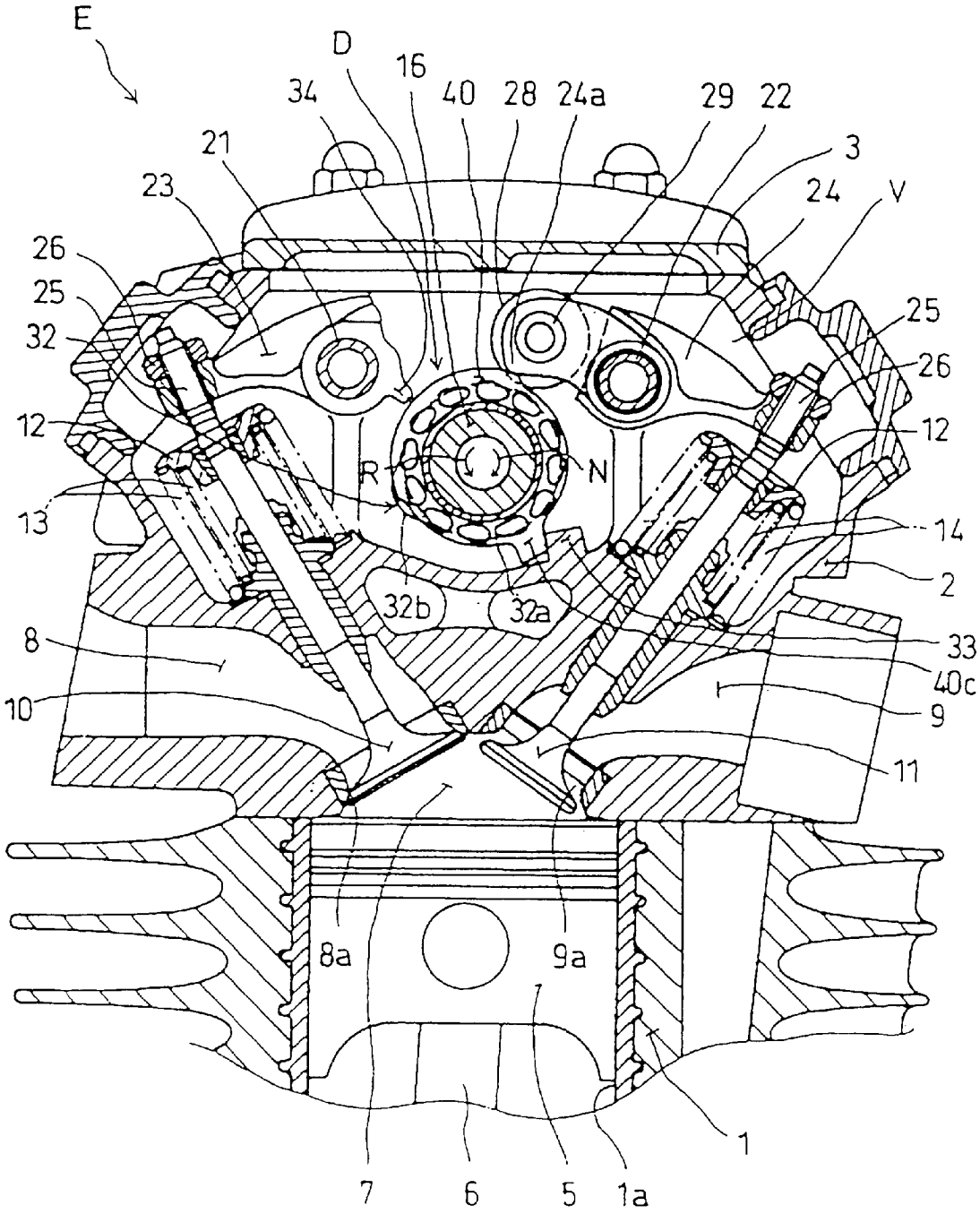
FIG. 1 is a side cross sectional view of an internal combustion engine provided with a starting device according to the present invention.
Figure 2:
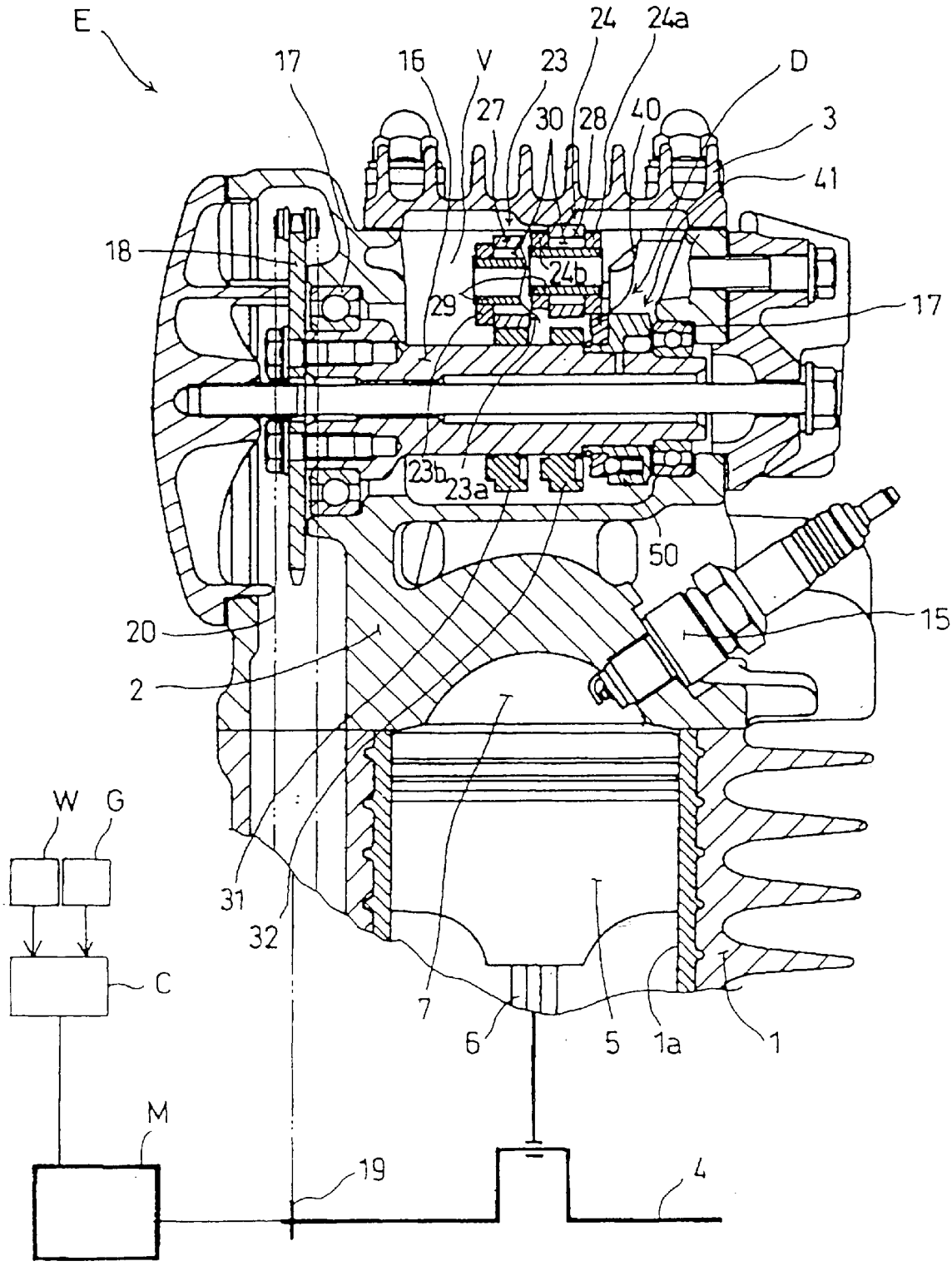
FIG. 2 is a cross sectional view showing a portion of the internal combustion engine shown in FIG. 1.
Figure 3:
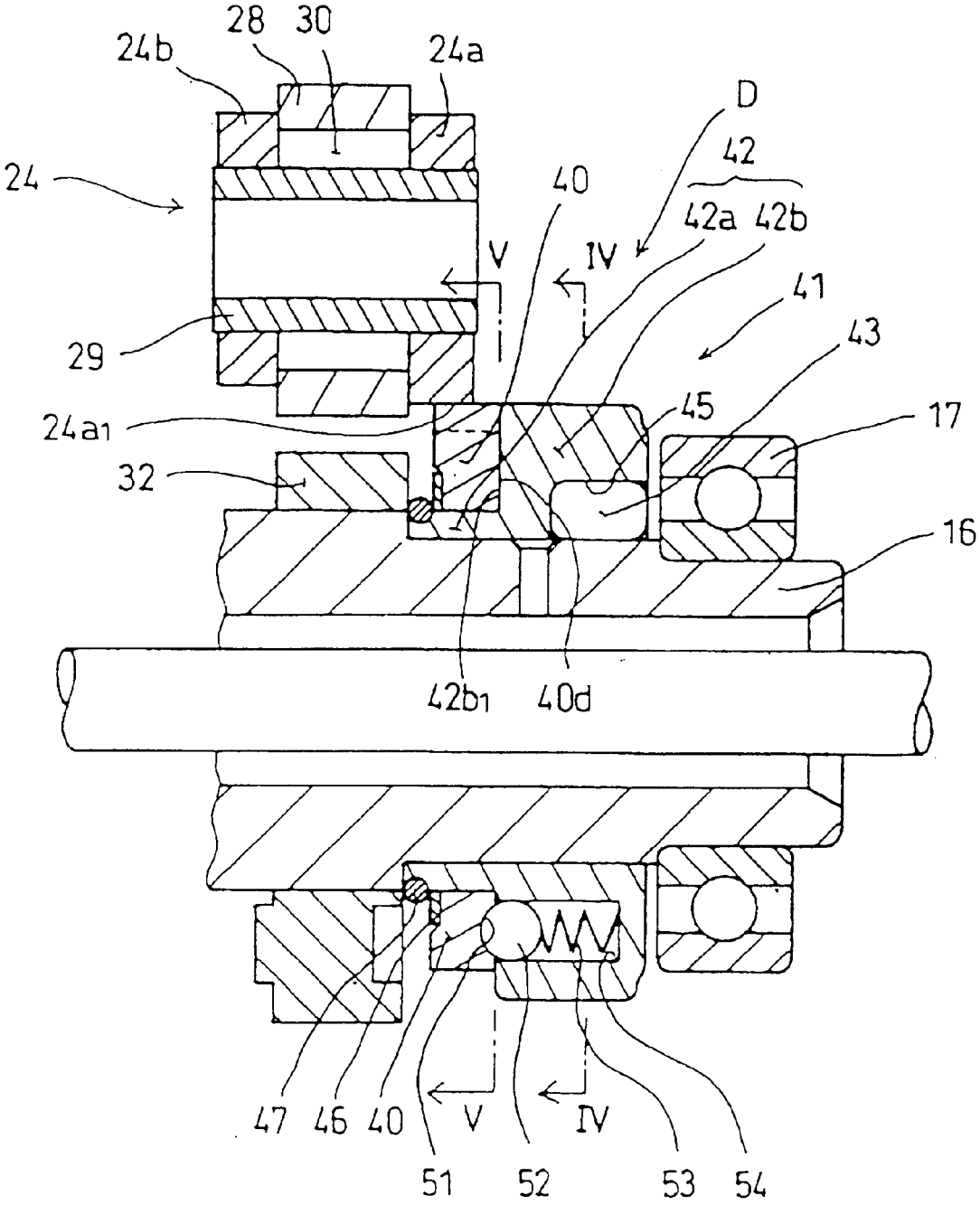
FIG. 3 is an enlarged cross sectional view showing a portion shown in FIG. 2.
Figure 4:
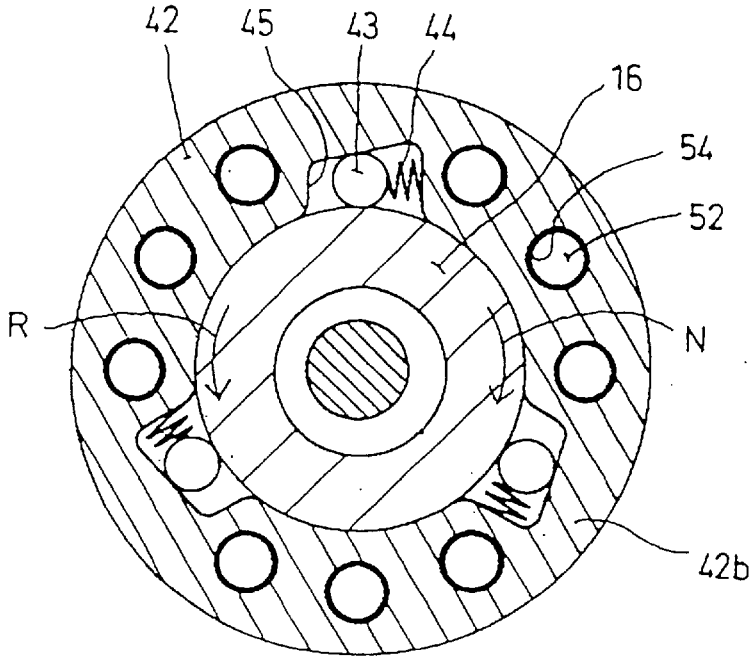
FIG. 4 is a cross sectional view taken along the line IV—IV in FIG. 3.
Figure 5:
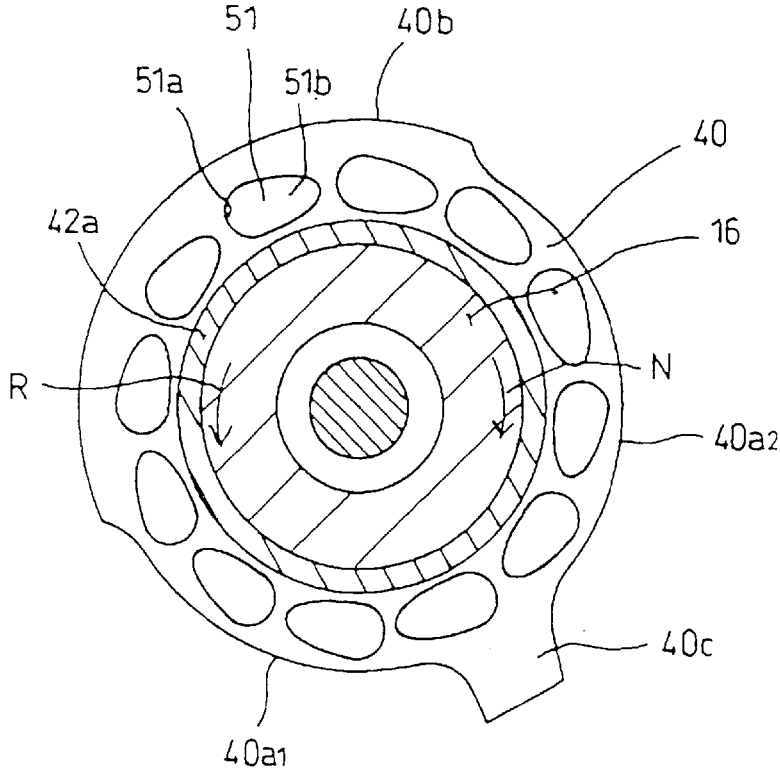
FIG. 5 is a partial, cross sectional view taken along the line V—V in FIG. 3 and showing a front view of a decompression cam.
Figure 6A:
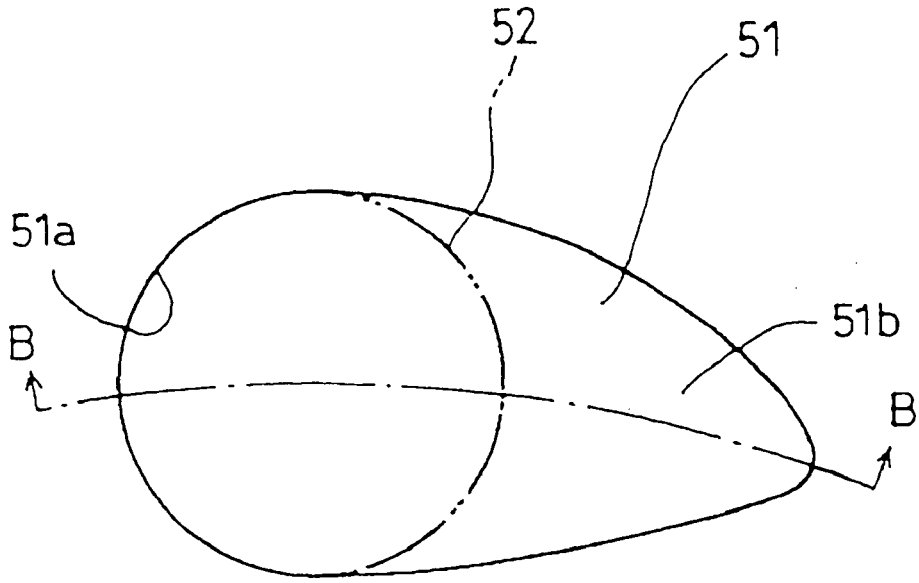
FIG. 6(A) is an enlarged, frontal view of a portion the decompression cam in FIG. 5.
Figure 6B:
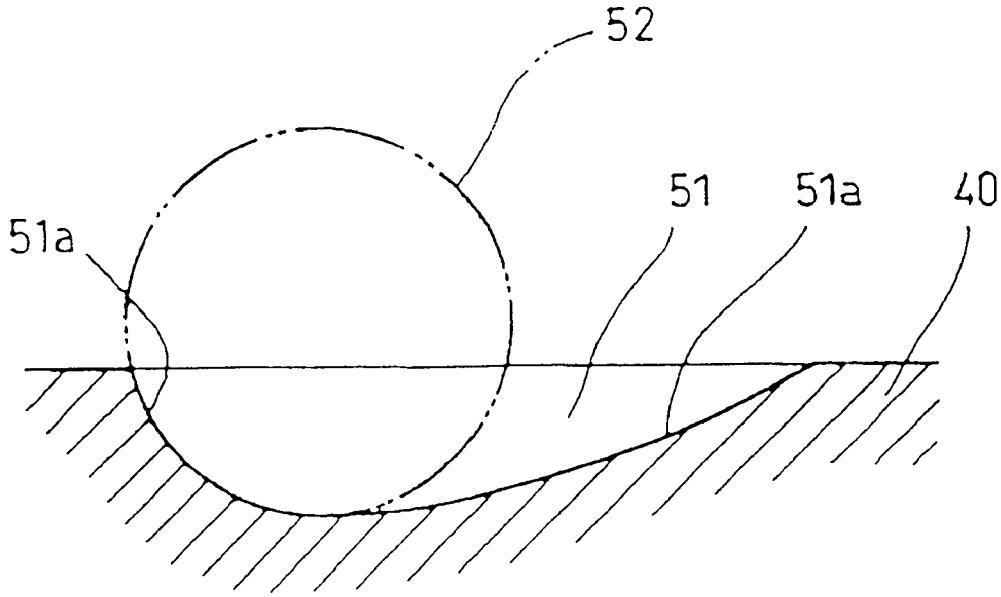
FIG. 6(B) is a cross sectional view taken along the line B—B in FIG. 6(A)

The present invention will hereinafter be described with reference to the accompanying drawings. Referring now to FIG. 1 through FIG. 14, the embodiments of the present invention will be described. FIG. 1 is a side cross sectional view of an internal combustion engine provided with a starting device according to the present invention. FIG. 2 is a cross sectional view showing a portion of the internal combustion engine shown in FIG. 1. FIG. 3 is an enlarged cross sectional view showing a portion shown in FIG. 2. FIG. 4 is a cross sectional view taken along the line IV—IV in FIG. 3. FIG. 5 is a partial, cross sectional view taken along the line V—V in FIG. 3 and showing a front view of a decompression cam. FIG. 6(A) is an enlarged, frontal view of a portion the decompression cam in FIG. 5. FIG. 6(B) is a cross sectional view taken along the line B—B in FIG. 6(A).

Figure 7:
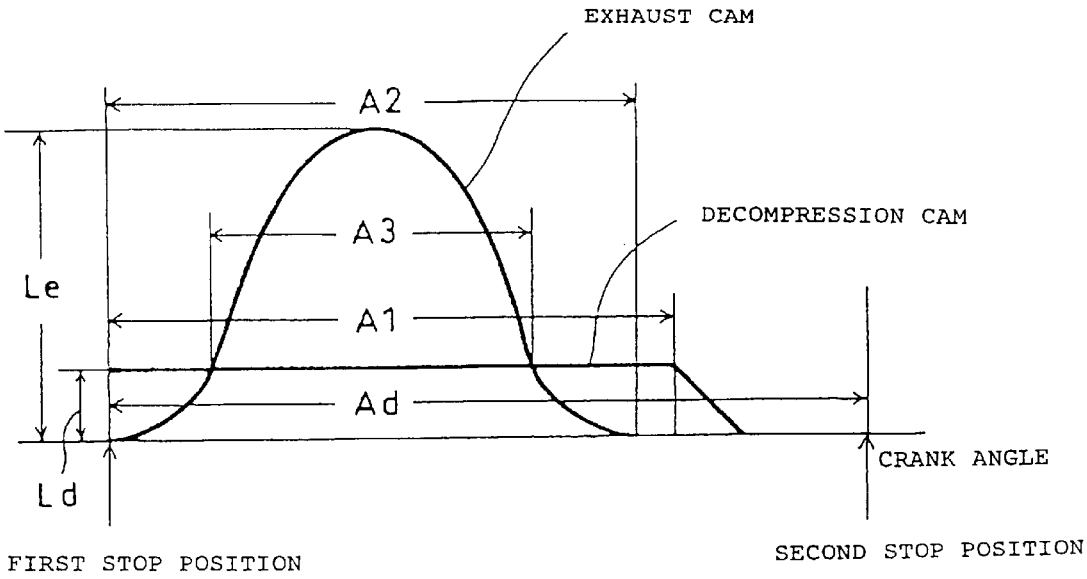
FIG. 7 is a graphical view showing a cam profile of the exhaust cam and the decompression cam in the internal combustion engine in FIG. 1.
Figure 8:
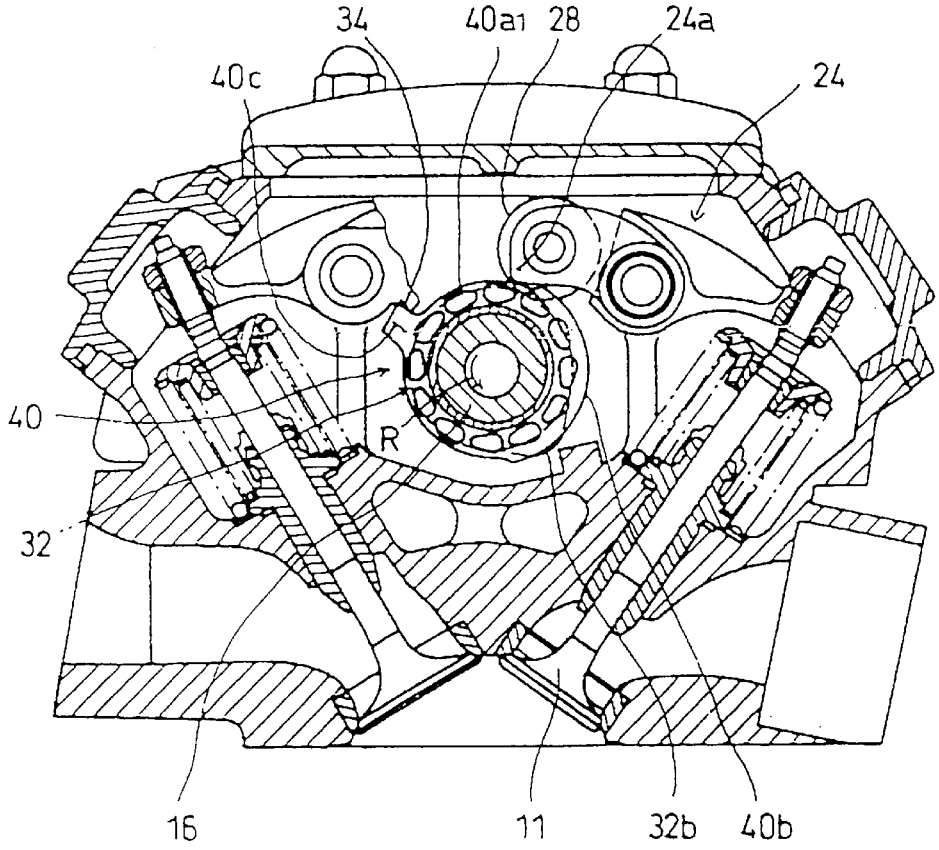
FIG. 8 is a cross sectional view showing a positional relationship among the decompression cam, the exhaust cam, and the associated components during startup of the internal combustion engine in FIG. 1.
Figure 9:
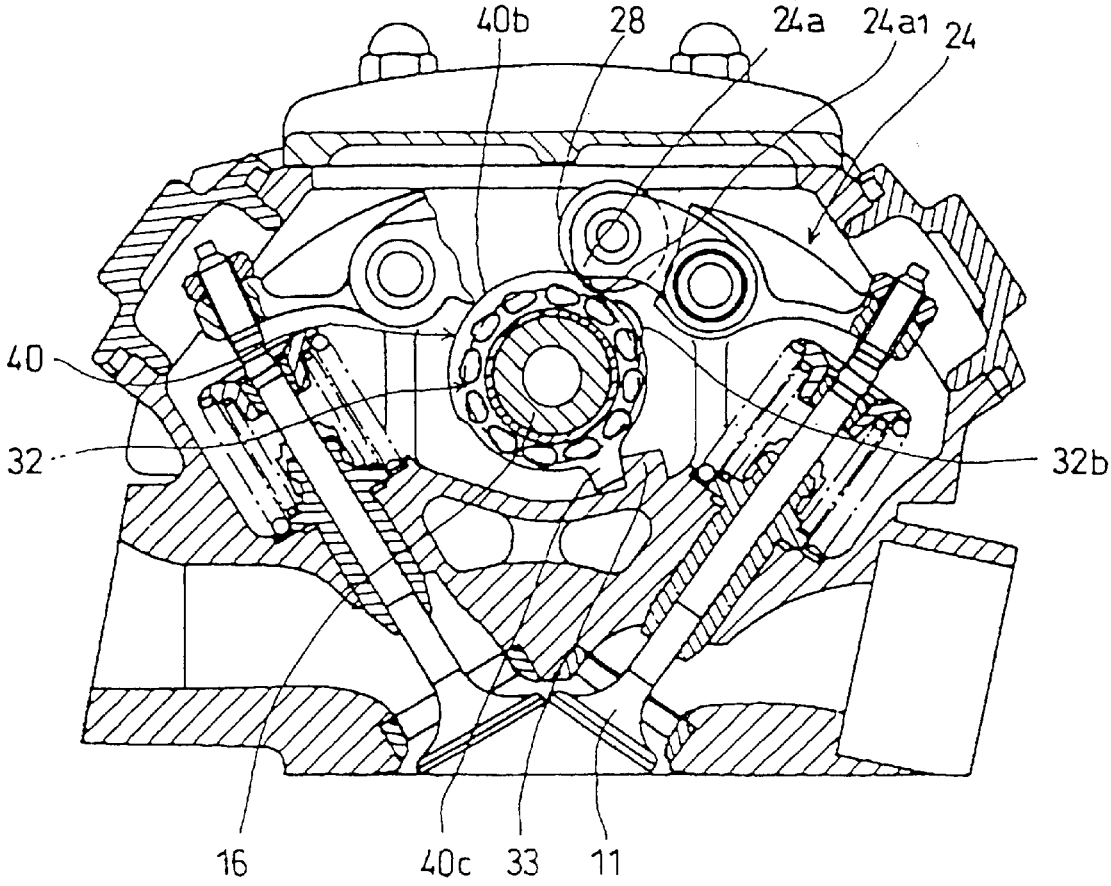
FIG. 9 is a cross sectional view showing a positional relationship of the components of FIG. 8 at initiation of normal rotation of the crankshaft during a decompression operation.
Figure 10:
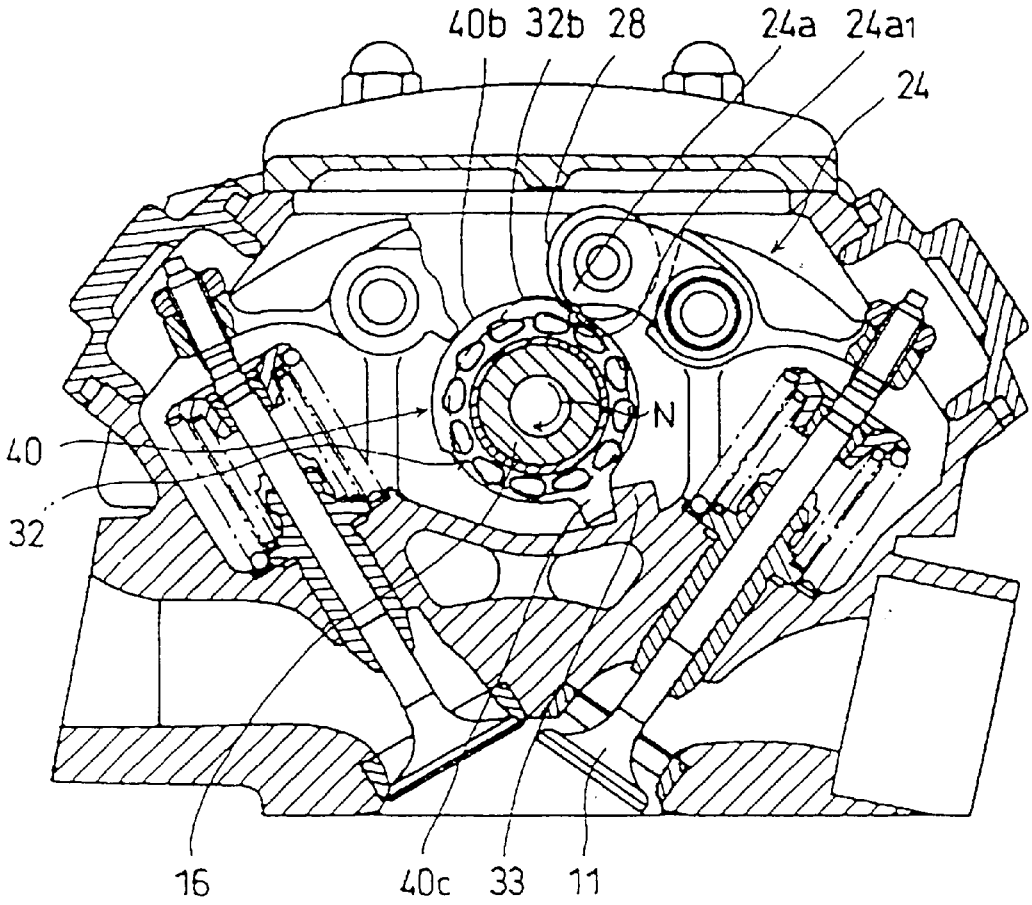
FIG. 10 is a cross sectional view showing a positional relationship of the components of FIG. 8 immediately before a first exhaust stroke, after initiation of normal rotation of the crankshaft.
Figure 11:
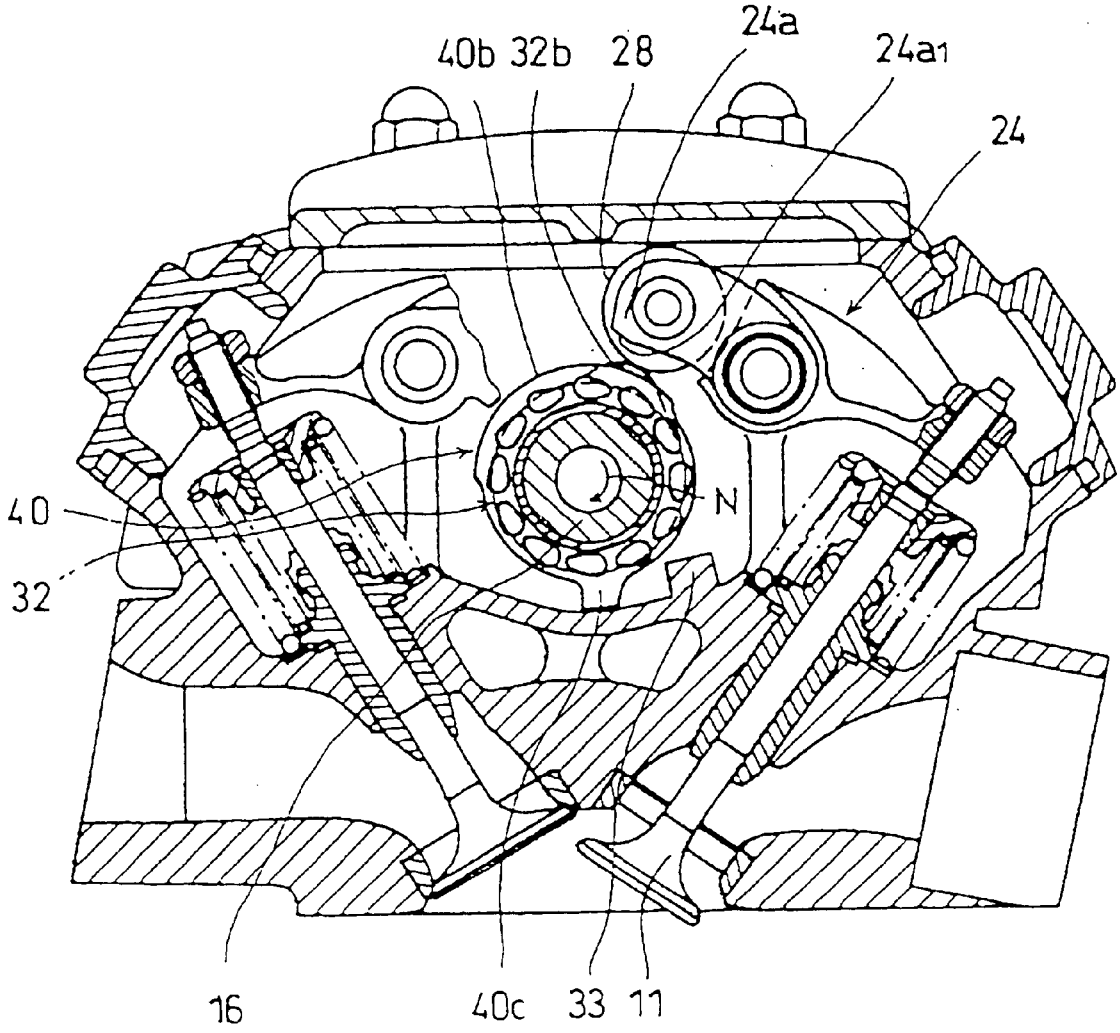
FIG. 11 is a cross sectional view showing a positional relationship of the components of FIG. 8 during the first exhaust stroke, after initiation of normal rotation of the crankshaft.
Figure 12:
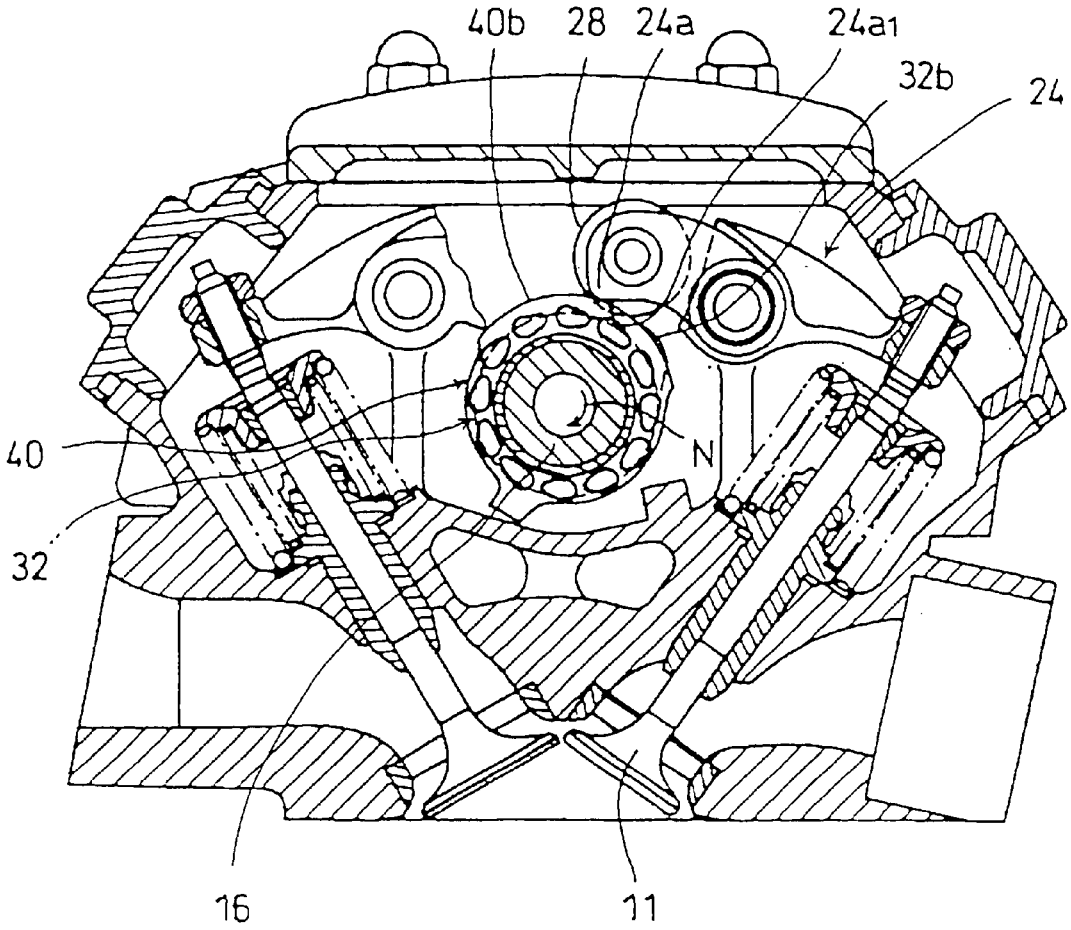
FIG. 12 is a cross sectional view showing a positional relationship of the components of FIG. 8 immediately after the first exhaust stroke, after initiation of normal rotation of the crankshaft.
Figure 13:
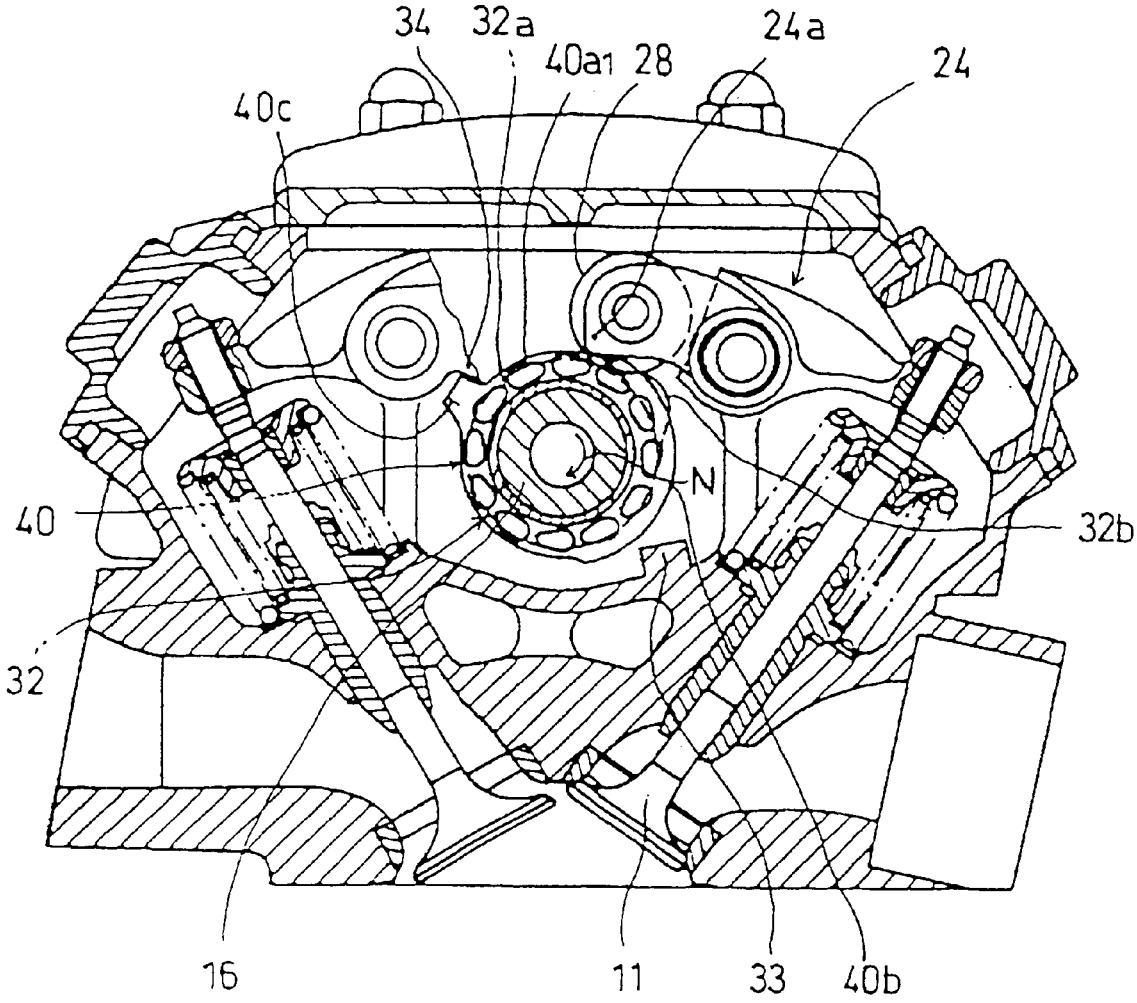
FIG. 13 is a cross sectional view showing a positional relationship of the components of FIG. 8 when the second exhaust stroke, after initiation of the normal rotation of the crankshaft, is terminated.
Figure 14:
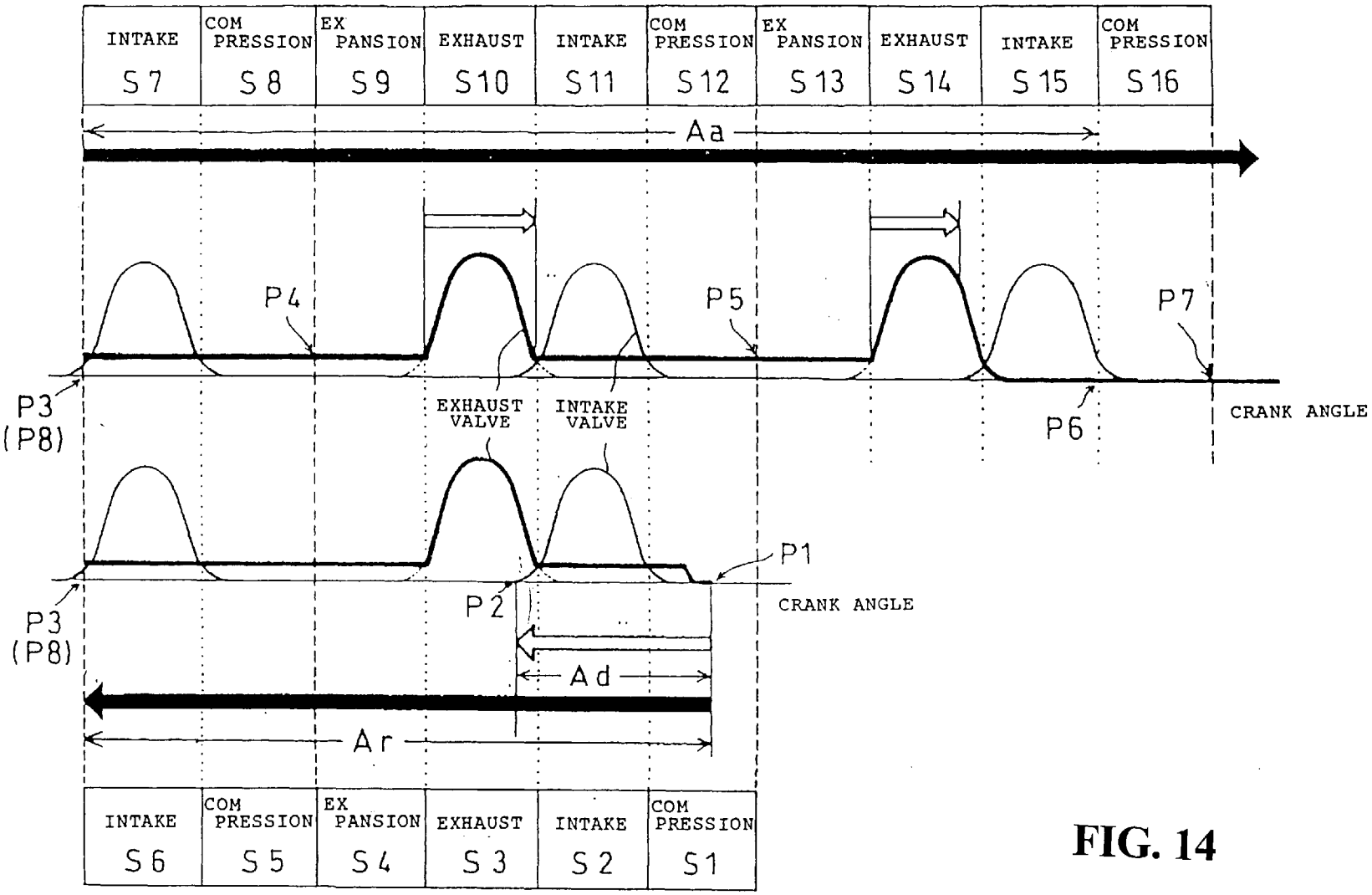
FIG. 14 is a graphical view showing the action of the decompression mechanism of the present invention in the internal combustion engine of FIG. 1.

FIG. 7 is a graphical view showing a cam profile of the exhaust cam and the decompression cam in the internal combustion engine in FIG. 1. FIG. 8 is a cross sectional view showing a positional relationship among the decompression cam, the exhaust cam, and the associated components during startup of the internal combustion engine in FIG. 1. FIG. 9 is a cross sectional view showing a positional relationship of the components of FIG. 8 at initiation of normal rotation of the crankshaft during a decompression operation. FIG. 10 is a cross sectional view showing a positional relationship of the components of FIG. 8 immediately before a first exhaust stroke, after initiation of normal rotation of the crankshaft. FIG. 11 is a cross sectional view showing a positional relationship of the components of FIG. 8 during the first exhaust stroke, after initiation of normal rotation of the crankshaft. FIG. 12 is a cross sectional view showing a positional relationship of the components of FIG. 8 immediately after the first exhaust stroke, after initiation of normal rotation of the crankshaft. FIG. 13 is a cross sectional view showing a positional relationship of the components of FIG. 8 when the second exhaust stroke, after initiation of the normal rotation of the crankshaft, is terminated. FIG. 14 is a graphical view showing the action of the decompression mechanism of the present invention in the internal combustion engine of FIG. 1.

In FIG. 1 and FIG. 2, an internal combustion engine E embodying the present invention is a SOHC type, single-cylinder, four-stroke internal combustion engine to be mounted on a motorcycle. The engine E includes a cylinder 1, a cylinder head 2 connected to the upper end of the cylinder 1, a cylinder head cover 3 connected to the upper end of the cylinder head 2, and a crankcase (not shown) connected to the lower end of the cylinder 1 for rotatably supporting a crankshaft 4. A piston 5 slidably fitted into a cylinder hole 1*a* is formed on the cylinder 1 and is connected to the crankshaft 4 via a connecting rod 6. The crankshaft 4 is rotated by the reciprocating piston 5. The crankshaft 4 is rotated by a starter motor M; e.g., an electric motor that is capable of rotating in the normal direction and in the reverse direction at startup of the internal combustion engine E. The drive of the starter motor M is controlled based on an output signal from an electronic control unit C, e.g., signals from a starter switch W and a rotational position sensor G are supplied for controlling the motor M.

The cylinder head 2 is formed with an air intake port 8 and an exhaust port 9 communicating with a combustion chamber 7 positioned upwardly of the cylinder hole 1*a*. The cylinder head 2 is provided with an intake valve 10 for opening and closing an intake valve port 8*a*, e.g., an opening of the air intake port 8 leading to the combustion chamber 7, and an exhaust valve 11 for opening and closing an exhaust valve port 9*a*, e.g., an opening of the exhaust port 9 leading to the combustion chamber 7. The intake valve 10 and the exhaust valve 11 are urged to close the intake valve port 8*a* and the exhaust valve port 9*a* respectively by valve springs 13, 14 mounted between retainers 12 integrally mounted between the respective ends of the springs and the cylinder head 2. An ignition plug 15 for burning an air-fuel mixture drawn into the combustion chamber 7 from the intake unit (not shown) through the air intake port 8 is screwed into the cylinder head 2 so as to face toward the combustion chamber 7.

In a dynamic valve chamber V defined by the cylinder head 2 and the cylinder head cover 3, a camshaft 16 disposed between the intake valve 10 and the exhaust valve 11 is rotatably supported by the cylinder head 2 via a pair of ball bearings 17. The camshaft 16 is rotated synchronously with the crankshaft 4 at half the revolving speed of the crankshaft 4 by a driving mechanism. The driving mechanism includes a driven sprocket 18 provided at one end of the camshaft 16, a driving sprocket 19 provided on the crankshaft 4, and a timing chain 20 routed on both of these sprockets 18, 19.

Further, a pair of rocker shafts 21, 22 disposed respectively in parallel with the camshaft 16 are secured to the cylinder head 2 at positions between the intake valve 10 and the camshaft 16, and between the exhaust valve 11 and the camshaft 16 in the dynamic valve chamber V. An intake rocker arm 23 and an exhaust rocker arm 24 are pivotally supported by the rocker shafts 21, 22 respectively. Tappet screws 25 that can abut against the extremities of the intake valve 10 and the exhaust valve 11 are adjustably screwed on the ends of the intake rocker arm 23 and the exhaust rocker arm 24, and are secured by a locknut 26.

The other ends of the intake rocker arm 23 and the exhaust rocker arm 24 are bifurcated by a pair of supporting portions 23*a*, 23*b*, and 24*a*, 24*b*, respectively, and a roller 27 and a roller 28 to be accommodated in the opening formed between the pair of supporting portions 23*a*, 23*b*; 24*a*, 24*b* are rotatably supported on a supporting shaft 29 fitted to the pair of supporting portions 23*a*, 23*b*; 24*a*, 24*b* via a needle bearing 30.

The roller 27 and the roller 28 are in rolling contact with an intake cam 31 and an exhaust cam 32 acting as the valve train cam provided on the camshaft 16. The exhaust cam 32 has a cam profile including a base circle portion 32*a* and a lift portion 32*b* having a prescribed operation angle A2 (See FIG. 7) for defining the valve-opening period and a cam lift for defining a prescribed lift amount. The intake cam 31 also has a cam profile including a base circle portion and the lift portion. The intake rocker arm 23 and the exhaust rocker arm 24 are pivoted according to these cam profiles to open and close the intake valve 10 and the exhaust valve 11 respectively in cooperation with the valve springs 13, 14. Therefore, both of the rocker arms 23, 24 serve as cam followers for opening and closing the intake valve 10 and the exhaust valve 11 while following the movement of the corresponding intake cam 31 and the exhaust cam 32.

Referring now to FIG. 3 to FIG. 5, the camshaft 16 is also provided with a decompression mechanism D for reducing the compression pressure in the combustion engine 7 during the compressing stroke for facilitating startup of the internal combustion engine E at startup. The decompression mechanism D includes a decompression cam 40 provided on the camshaft 16, a torque transmission mechanism, and a rotation control device. The decompression cam 40 can be rotated in the same direction as the rotational direction of the camshaft 16 that rotates in the normal and reverse directions by the torque of the camshaft 16 transmitted by the torque transmission mechanism.

The torque transmission mechanism includes a one-way clutch 41 and a torque limiter 50 disposed in series in the torque transmission route through which torque is transmitted from the camshaft 16 to the decompression cam 40. The one-way clutch 41 is attached on the periphery of the camshaft 16 on the side of the camshaft 16 axially opposite from the intake cam 31 so as to contact the periphery of the exhaust cam 32. The one-way clutch 41 includes a cylindrical outer ring 42 fitted on the camshaft 16 so as to be capable of relative rotation and a clutch element including a roller 43 and a coil spring 44 on the periphery thereof.

The outer ring 42 has a smaller diameter portion 42*a* and a larger diameter portion 42*b* that has a diameter larger than the smaller diameter portion 42*a*. The larger diameter portion 42*b* is formed on its inner peripheral surface with three cam grooves 45 each having a depth that decreases toward the direction of reverse rotation R, which is the opposite direction from the direction of normal rotation N of the camshaft 16, at regular intervals in the circumferential direction. The roller 43 and the coil spring 44 for urging the roller 43 toward the shallower side in the cam groove 45 are accommodated in each cam groove 45.

When the camshaft 16 is rotated in the normal direction synchronously with the normal rotation of the crankshaft 4, the roller 43 moves toward the deeper side in the cam groove 45 in opposition to the spring force of the coil spring 44. Accordingly, the one-way clutch 41 is brought into the unconstrained state in which relative rotation between the camshaft 16 and the outer ring 42 is enabled. However, in this unconstrained state, inconsiderable drag torque in the normal direction N, that will be described later, is transmitted from the camshaft 16 to the outer ring 42 by a slight force transmitted to the outer ring 42 via the coil spring 44. The force transmitted to the outer ring 42 via the coil spring 44 is based on a frictional force between the camshaft 16 and the roller 43 and a slight frictional force between the camshaft 16 and the outer ring 42.

When the camshaft 16 rotates synchronously with reverse rotation of the crankshaft 4 in the reverse direction, the roller 43 moves toward the shallower side in the cam groove 45 and is caught between the camshaft 16 and the outer ring 42. The one-way clutch 41 is brought into the constrained state in which relative rotation between the camshaft 16 and the outer ring 42 is disabled, and thus reverse rotation torque of the camshaft 16 is transmitted to the outer ring 42, and the camshaft 16 and the outer ring 42 rotate integrally in the reverse direction.

The smaller diameter portion 42*a* of the outer ring 42 is fitted with the ring-shaped decompression cam 40 on the outer periphery thereof so as to be capable of relative rotation. The axial movement of the decompression cam 40 is limited by a stopper ring 47 fitted in the annular groove formed on the outer periphery of the smaller diameter portion 42*a* with a washer 46 interposed therebetween. An end face 40*d* is opposed to the larger diameter portion 42*b* in the axial direction and is maintained in surface contact with an end face 42*b*1 of the larger diameter portion 42*b* in opposition to the spring force of a coil spring 53 including the torque limiter 50.

The torque limiter 50 is provided between the decompression cam 40 and the one-way clutch 41 for transmitting torque of the camshaft 16 transmitted to the one-way clutch 41 to the decompression cam 40. The torque limiter 50 includes an engaging portion provided on the end face 40*d* of the decompression cam 40, and an engaging element including a ball 52 and the coil spring 53 for engaging the engaging portion. The engaging portion includes a plurality of, for example, twelve engaging grooves 51 formed circumferentially at regular intervals on the end face 40*d* of the decompression cam 40, and each engaging groove 51. Each engaging groove 51 includes, as shown in FIG. 6, a steeply inclined portion 51*a* on which a part of the ball 52 is brought into surface contact and which is reduced suddenly in depth toward the direction of reverse rotation R, and a gradually inclined portion 51*b*, that is reduced gradually in depth toward the normal rotational direction N.

The larger diameter portion 42*b* of the outer ring 42 is formed for example with three accommodation holes 54 having bottoms extending in the axial direction and each opening on the end surface 42*b*1 at positions between the three circumferentially adjacent cam grooves 45 at intervals to come in alignment with three, circumferentially adjacent engaging grooves 51 in the axial direction. Each accommodation hole 54 accommodates the ball 52 and the coil spring 53 for urging the ball 52 toward the decompression cam 40 in the axial direction.

When the engaging groove 51 and the ball 52 are brought into alignment and a part of the ball 52 is fitted into and pressed against the steeply inclined portion 51*a* of the engaging groove 51 by a spring force of the coil spring 53, the torque limiter 50 transmits torque transmitted from the camshaft 16 through the outer ring 42 to the decompression cam 40 directly, and integrally rotates the outer ring 42 and the decompression cam 40. When reverse rotation torque applied from the outer ring 42 to the decompression cam 40 exceeds the upper limit torque, e.g., a maximum torque at which the decompression cam 40 and the outer ring 42 can be integrally rotated, the ball 52 is forced out from the steeply inclined portion 51*a* by such excessive torque, and the torque limiter 50 blocks transmission to the outer ring 42. Accordingly, only the outer ring 42 is rotated integrally with the camshaft 16 in the reverse direction by reverse rotation torque transmitted from the camshaft 16.

The upper limit torque is set at a value larger than a rotational resistance torque generated by a frictional force between the cam portion of the decompression cam 40 and the exhaust rocker arm 24 that is in contact with the cam portion when the crankshaft 4 rotates in the reverse direction. The maximum torque at which the decompression cam 40 and the outer ring 42 can rotate integrally is set at a value smaller than the upper limit torque in the reverse rotation from the gradually inclined portion 51*b* of the engaging groove 51. This is because the torque transmitted to the decompression cam 40 is drag torque in contrast to normal rotational torque applied from the outer ring 42 to the decompression cam 40. The gradually inclined portion 51*b* enables the ball 52 moving toward the engaging groove 51, which is adjacent in the reverse rotational direction R, to smoothly fit into the engaging groove 51 in the case where the decompression cam 40 abuts against a reverse rotation stopper 33. Accordingly, only the outer ring 42 rotates in the reverse direction.

As shown in FIG. 1 and FIG. 5, the decompression cam 40 with which a slipper portion 24*a*1 (See FIG. 3) comes into contact includes a projecting portion 40*c* projecting in the radial direction, a pair of base circle portions 40*a*1, 40*a*2 extending circumferentially with the projecting portion 40*c* interposed therebetween, and a lift portion 40*b* continuing from both of the base circle portions 40*a*1, 40*a*2 and projecting in the radial direction. The slipper portion 24*a*1 is a part of the outer peripheral surface of one of the supporting portions 24*a* of the exhaust rocker arm 24.

The projecting portion 40*c* abuts against the reverse rotation stopper 33 provided on the cylinder head 2 (see FIG. 1) when the decompression cam 40 rotates in the reverse direction, thereby preventing the decompression cam 40 from further rotating in the reverse direction. The projecting portion 40*c* abuts against a normal rotation stopper 34 secured to the rocker shaft 21 when the decompression cam 40 rotates in the normal direction, thereby preventing the decompression cam 40 from further rotating in the normal direction. The decompression cam 40 can therefore only rotate between the reverse rotation stopper 33 that defines the first stop position in the reverse rotational direction R, and the normal rotation stopper 34 that defines the second stop position in the normal rotational direction N.

The base circle portions 40*a*1, 40*a*2 of the decompression cam 40 have diameters so that the slipper portion 24*a*1 comes into contact with the base circle portions 40*a*1, 40*a*2 when the roller 28 is in contact with the base circle portion 32*a* of the exhaust cam 32. The lift portion 40*b* is formed circumferentially along a prescribed range so as to project by a constant amount in the radial direction. The lift portion 40*b* has a cam lift defining a prescribed lift amount for decompression Ld, which is smaller than the maximum lift amount Le of the exhaust valve 11 lifted by the exhaust cam 32, as shown in FIG. 7 for performing decompression operation for reducing the compression pressure in the combustion chamber 7.

The cam profile of the decompression cam 40 includes the part of the lift portion 40*b* with which the slipper portion 24*a*1 contacts the part of the base circle 40*a*1 with which the slipper portion 24*a*1 contacts within the range of a preset rotational angle Ad, e.g., the angle that the decompression cam 40 rotates between the reverse rotation stopper 33 and the normal rotation stopper 34, out of the part of the base circle portion 40*a*1 and the lift portion 40*b* extending from the projecting portion 40*c* in the normal rotational direction N. With such a cam profile, when the decompression cam 40 is at the first stop position, the lift portion 40*b* is at a position where it can come into contact with the slipper portion 24*a*1, and the decompression cam 40 can open the exhaust valve 11. When the decompression cam 40 is at the second stop position, the base circle portion 40*a*1 is at the position where it can come into contact with the slipper portion 24*a*1, and the decompression cam 40 can close the exhaust valve 11.

Further, the effective operation angle A1, e.g., the angular range of the lift portion 40*b* having a constant cam lift in the aforementioned cam profile, is set to the value larger than the angle of decompression operation A3 of the exhaust cam 32. The angular range where the exhaust valve 11 opened by the decompression cam 40 is opened by a lift amount larger than the lift amount for decompression Ld by the lift portion 32*b* of the exhaust cam 32. The decompression operation is not stopped by opening of the exhaust valve 11 during the first exhaust stroke after the crankshaft 4 starts to rotate in the normal direction. The angular range is simultaneously smaller than twice the angle of decompression operation A3 so that the decompression operation is released by opening of the exhaust valve 11 during the second exhaust stroke after the crankshaft 4 starts to rotate in the normal direction. In this embodiment, the preset rotational angle Ad is set to a value smaller than twice the operation angle A2 of the exhaust cam 32.

The rotation control device includes the exhaust rocker arm 24 that applies a pressing force based on a spring force of the valve spring 14 on the decompression cam 40 with the slipper portion 24*a*1 being contacted with the lift portion 40*b* of the decompression cam 40. In the decompression operation in which the exhaust valve 11 is opened by the decompression cam 40, the exhaust rocker arm 24 applies rotational resistance torque caused by a frictional force between the slipper portion 24*a*1 and the lift portion 40*b* on the decompression cam 40 by the pressing force.

Since the rotational resistance torque is set to be larger than the drag torque, the exhaust rocker arm 24 prevents the decompression cam 40 from rotating in the normal direction by the drag torque generated when the camshaft 16 is rotated in the normal direction when the slipper portion 24*a*1 is in contact with the lift portion 40*b* of the decompression cam 40. This also allows the decompression cam 40 to rotate in the normal direction by the drag torque when the roller 28 of the exhaust rocker arm 24 is in contact with the lift portion 32*b* of the exhaust cam 32 and the slipper portion 24*a*1 moves away from the lift portion 40*b* of the decompression cam 40 so that the exhaust valve 11 is opened by the exhaust cam 32.

Referring now to FIG. 2, the electronic control unit C is supplied with a signal detected from the rotational position sensor G for detecting the rotational position of the camshaft 16. The specific rotational position of the camshaft 16, e.g., an exhaust top dead center, is detected by the sensor, and the rotational position of the crankshaft 4 where the crankshaft 4 stops reverse rotation after the decompression cam 40 is abutted against the reverse rotation stopper 33 is set to the second exhaust top dead center (the rotational position P8 in FIG. 14) after initiation of reverse rotation. At the exhaust top dead center, the lift amount of the exhaust valve 11 is smaller than the lift amount for decompression Ld, so that the slipper portion 24*a*1 of the exhaust rocker arm 24 can abut against the decompression cam 40.

Accordingly, the electronic control unit C controls the drive of the starter motor M in such a manner that when the ON-signal is supplied by the starter switch W, the starter motor M is rotated in the reverse direction and the crankshaft 4 is rotated in the reverse direction by the initial reverse rotation angle Ar (See FIG. 14) to the second exhaust top dead center at which the angle is larger than the preset rotational angle Ad (See FIG. 7). Subsequently, the starter motor M is rotated in the normal direction to rotate the crankshaft 4 in the normal direction.

With reference to FIG. 1, FIG. 2 and FIG. 7 to FIG. 14, the action of the decompression mechanism D will be described hereinafter. As shown in FIG. 14, it is assumed that at startup of the internal combustion engine E (rotational position PI), the crankshaft 4 is stopped in the middle of the compression stroke S1, and the decompression cam 40 is at the second stop position where it abuts against the normal rotation stopper 34 (See FIG. 8). In this case, description is made assuming that reverse rotation of the crankshaft 4 did not occur when the internal combustion engine E is stopped.

However, even when reverse rotation occurred, the same action as the following description will basically be carried out except for the position of the decompression cam 40 at startup that it reaches after rotating in the direction of reverse rotation R from the normal rotation stopper 34. In FIG. 14, the rotational position of the crankshaft 4 is shown by the largest bold-faced arrow, the rotational position of the decompression cam 40 is shown by the hollow arrow, and whether exhaust valve 11 is opened or closed is shown by the arrow of moderate thickness.

When the starter switch W is turned on, the starter motor M rotates in the reverse direction by the instruction from the electronic control unit C and thus the crankshaft 4 and the camshaft 16 are rotated in the reverse direction. Fueling and ignition in the internal combustion engine E are stopped when the crankshaft 4 rotates in the reverse direction, and are started after initiation of the normal rotation of the crankshaft 4. The one-way clutch 41 is brought into the constrained state by reverse rotation of the camshaft 16, and the outer ring 42 rotates integrally with the camshaft 16 in the reverse direction. In this case, since the rotational resistance torque based on a frictional force caused by contact between the slipper position 24*a*1 of the exhaust rocker arm 24 and the base circle portion 40*a*1 and lift portion 40*b* of the decompression cam 40 is smaller than the aforementioned upper limit torque, the decompression cam 40 rotates integrally with the camshaft 16 in the reverse direction by reverse rotation torque applied from the camshaft 16 and the outer ring 42 through the torque limiter 50 to the decompression cam 40.

In the middle of reverse rotation of the camshaft 16, the slipper portion 24*a*1 comes into contact with the lift portion 40*b* of the decompression cam 40, and the exhaust rocker arm 24 is pivoted. The exhaust valve 11 is thus opened by the lift amount for decompression Ld. Subsequently, after the first intake stroke S2 of the internal combustion engine E after initiation of reverse rotation the decompression cam 40 stops at the aforementioned first stop position at the moment when the projecting portion 40*c* of the decompression cam 40 abuts against the reverse rotation stopper 33 (rotational position P2), and further reverse rotation is prevented. Actually, since the crankshaft 4 is rotated in the reverse direction, the piston 5 moves toward the top dead center, but it is referred as intake stroke as a matter of convenience. Hereinafter, the name of the stroke when the crankshaft 4 is rotated in the normal direction is also used when it is rotated in the reverse direction.

Therefore, the rotational resistance torque applied on the decompression cam 40 exceeds the upper limit torque, and the aforementioned excessive torque is applied on the torque limiter 50 to release the ball 52 of the torque limiter 50 from being fitted into the steeply inclined portion 51 a of the engaging groove 51. Therefore, only the outer ring 42 rotates integrally with the camshaft 16 in the reverse direction. This additional reverse rotation continues during the exhaust stroke S3, the expansion stroke S4, and the compression stroke S5 and the intake stroke S6, and terminates when the crankshaft 4 is rotated by the initial reverse rotation angle Ar in the reverse direction (rotational position P3) at the timing of the second exhaust top dead center after initiation of reverse rotation is detected by the rotational position sensor G (See FIG. 9). In this example, the slipper portion 24*a*1 of the exhaust locker arm 24 is in contact with the lift portion 40*b* of the decompression cam 40 at the time when reverse rotation is terminated, and the exhaust valve 11 is opened by the lift amount for decompression Ld.

With instruction(s) from the electronic control unit C, the starter motor M rotates in the normal direction to rotate the crankshaft 4 and the camshaft 16 in the normal direction. In this case, the one-way clutch 41 is brought into an unconstrained state by the normal rotation of the camshaft 16, and the outer ring 42 applies the drag torque (smaller than the aforementioned upper limit torque) on the decompression cam 40 through the torque limiter 50. The rotational resistance torque generated by the slipper portion 24*a*1 of the exhaust rocker arm 24 being in contact with the lift portion 40*b* of the decompression cam 40 urged by the valve spring 14 is larger than the drag torque until the rotational position of the crankshaft 4 in an intake stroke S7 passes through the first compression stroke S8 and the expansion stroke S9 after initiation of normal rotation of the crankshaft 4 (or the camshaft 16) and reaches the first exhaust stroke S10 (See FIG. 10). Accordingly, the decompression cam 40 does not rotate in the normal direction, and stops at the first stop position.

Therefore, in the first compression stroke S8, since the exhaust valve 11 is opened by the lift amount for decompression Ld so that the decompression operation is performed. Thus, the compression pressure in the combustion chamber 7 is reduced, and the piston 5 can easily overcome the compression top dead center (rotational position P4). In the first exhaust stroke S10, the camshaft 16 is rotated in the normal direction, and the roller 28 of the exhaust rocker arm 24 is brought into contact with the exhaust cam 32, and then the exhaust rocker arm 24 is pivoted by the exhaust cam 32. The exhaust valve 11 is subsequently opened by a lift amount larger than the lift amount of the decompression cam 40 (See FIG. 11).

Accordingly, the slipper portion 24*a*1 moves away from the lift portion 40*b* of the decompression cam 40, and thus rotational resistance torque of the decompression cam 40 is reduced to the value smaller than the drag torque. The decompression cam 40 rotates in the normal direction with the outer ring 42 at the same rotational speed with the camshaft 16 by the drag torque. Though such normal rotation of the decompression cam 40 is generated in the region of the angle of decompression operation A3 of the exhaust cam 32, since the effective operation angle A1 of the decompression cam 40 is larger than the angle of decompression operation A3, the slipper portion 24*a*1 comes into contact with the lift portion 40*b* of the decompression cam 40 again in the final period of the first exhaust stroke S10. The exhaust valve 11 is then opened by the lift amount for decompression Ld. Since the rotational resistance torque of the decompression cam 40 is increased to the value larger then the drag torque, the rotation of the decompression cam 40 stops (See FIG. 12).

Subsequently, only the camshaft 16 rotates further in the normal direction, and the decompression operation is performed in the second compression stroke S12, e.g., the first compression stroke after normal rotation of the decompression cam 40. Therefore, the piston 5 can easily overcome the compression top dead center (rotational position P5). Then, the camshaft 16 further rotates in the normal direction through the expansion stroke S13. During the second exhaust stroke S14 after initiation of normal rotation of the crankshaft 4, the slipper portion 24*a*1 moves away from the decompression cam 40 when the exhaust valve 11 is opened by the exhaust cam 32 as in the case of the first exhaust stroke S10. The decompression cam 40 therefore rotates in the normal direction at the same rotational speed with the camshaft 16 by the drag torque.

However, the effective operation angle A1 of the decompression cam 40 is smaller than twice the angle of decompression operation A3 of the exhaust cam 32, and the preset rotational angle Ad is smaller than twice the operation angle A2 of the exhaust cam 32 (See FIG. 7). Therefore, the projection 40*c* of the decompression cam 40 abuts against the normal operation stopper 34 during the second exhaust stroke S14, and the decompression cam 40 takes the second stop position. Consequently, when the second exhaust stroke S14 terminates, the slipper portion 24*a*1 comes into contact with the base circle portion 40*a*1 of the decompression cam 40. The exhaust valve 11 thus moves according to the cam profile of the exhaust cam 32 with which the roller 28 of the exhaust rocker arm 24 comes into contact and is brought into closed state (See FIG. 13). Accordingly, the decompression operation by the decompression mechanism D with respect to the exhaust valve 11 is stopped, and the exhaust valve 11 thereafter is opened and closed only by the exhaust cam 32.

Next, the camshaft 16 further rotates in the normal direction through the intake stroke S15. During the third compression stroke S16 after initiation of normal rotation of the crankshaft 4, the air-fuel mixture is compressed at the normal compression pressure without reducing the pressure by the decompression operation and ignited by the ignition plug 15. The internal combustion engine E proceeds to the starting operation, and then to the idle operation. In this third compression stroke S16, since the crank angle from initiation of normal rotation of the crankshaft 4 to the compression starting portion P6 of the third compression stroke S16 (the first compression stroke starting point, compression bottom dead center while the crankshaft 4 is rotated in the normal direction and after the decompression operation is released, rotational position P6), e.g., the run-up angle Aa of the crankshaft 4 is large in comparison with the case where the crankshaft 4 is rotated in the normal direction. When the crankshaft is rotated in the normal direction immediately from the startup position of the internal combustion engine E for performing the regular compression stroke, the acceleration time is increased, and the crankshaft 4 rotates at a faster rotational speed, thereby facilitating the piston to overcome the compression top dead center P7 at the regular compression pressure.

The operation and effects of the present invention as described thus far will be described hereinafter. At startup of the internal combustion engine E, the starter motor M controlled by the electronic control unit C rotates the crankshaft 4 and thus the camshaft 16 in the reverse direction by the initial reverse rotation angle Ar. The starter motor M then rotates the same in the normal direction, so that the decompression cam 40 is rotated integrally with the camshaft 16 in the reverse direction via the one-way clutch 41 that is brought into the constrained state during reverse rotation of the crankshaft 4 to the first stop position. The exhaust rocker arm 24 is brought into abutment with the lift portion 40*b* of the decompression cam 40 to enable opening of the exhaust valve 11. Subsequently, the crankshaft 4 and the camshaft 16 are further rotated in the reverse direction with the decompression cam 40 kept at the first stop position by the action of the torque limiter 50.

After initiation of normal rotation of the crankshaft 4, the exhaust rocker arm 24 prevents normal rotation of the decompression cam 40, on which the drag torque is transmitted from the one-way clutch 41, by applying rotational resistance torque thereon and bringing the slipper portion 24*a*1 into contact with the lift portion 40*b* of the decompression cam 40. The exhaust rocker arm 24 permits normal rotation of the decompression cam 40 by the drag torque when the roller 28 is brought into contact with the exhaust cam 32 and the slipper portion 24*a*1 is moved away from the decompression cam 40. Accordingly, the decompression cam 40 has an effective operation angle A1 set at a value larger than the angle of decompression operation of the valve train cam for opening and closing the exhaust valve 11 that is opened by the decompression cam 40 at startup.

The angle of decompression operation of the decompression cam is smaller than twice the angle of decompression operation of the exhaust cam 32. The decompression cam performing decompression with the exhaust valve 11 is opened by the lift amount for decompression Ld during the first compression stroke S8. The angle of decompression operation is included in the initial reverse rotation angle Ar of the reverse rotation, during the first compression stroke S12 after start of normal rotation of the decompression cam 40 and during the period from the first stop position to the second stop position.

Accordingly, the run-up angle Aa increases by the amount corresponding to the reverse rotation of the crankshaft 4 from the rotational position PI of the crankshaft 4 at startup of the internal combustion engine E by the initial reverse rotation angle Ar. The rotational speed of the crankshaft 4 at the first compression starting point (rotational position P6) after release of the decompression operation thus increases, so that the piston can easily overcome the first compression top dead center (rotational position P7) after stoppage of decompression operation. This improves starting capability while avoiding an undesirable increase in the size and capacity of the starter motor M that rotates the crankshaft 4. In addition, an increase in the run-up angle Aa can be realized with the simple structure of the present invention by setting the effective operation angle A1 of the lift portion 40*b* of the decompression cam 40.

In addition, the decompression cam 40 can be placed in such a manner that the exhaust rocker arm 24 is always in contact with a fixed position of the lift portion 40*b* of the decompression cam 40 at startup of normal rotation of the crankshaft 4 (rotational position P3), irrespective of the rotational position PI of the crankshaft 4 at startup of the internal combustion engine E, by placing the decompression cam 40 at the first stop position when rotating the crankshaft 4 in the reverse direction. Accordingly, the angular range in which the exhaust valve 11 can be opened by the decompression cam 40, e.g., the effective operation angle A1, can be set to a fixed position for every startup, thereby ensuring the run-up angle Aa larger than that achieved in the background art.

The torque limiter 50 for preventing reverse rotation torque exceeding upper limit torque from being applied on the decompression cam 40 when the crankshaft 4 rotates in the reverse direction is provided in series with the one-way clutch 41 in the torque transmission route extending from the camshaft 16 to the decompression cam 40. Therefore, when the crankshaft 4 is rotated in the reverse direction during which relative rotation of the camshaft 16 and the decompression cam 40 is disabled by the one-way clutch 41, the torque limiter 50 allows further reverse rotation of the crankshaft 4 after the decompression cam 40 abuts against the reverse rotation stopper 33 at the first stop position. This arrangement permits an increase of the run-up angle with a simple structure. In addition, the torque limiter 16 prevents excessive torque from being applied on the decompression cam 40, the reverse rotation stopper 33 and the one-way clutch 41.

Hereinafter, an embodiment in which the aforementioned embodiment is modified will be described relating to the modified construction. In the aforementioned embodiment, although the initial reverse rotation angle Ar is set up to the second exhaust top dead center after initiation of reverse rotation based on the detected signal from the rotational position sensor G, it may be the angle set according to the rotational position of the camshaft 16 whereof the angle is larger than the preset rotational angle Ad. For example, an angle up to the first exhaust top dead center after initiation of reverse rotation, or may be an angle set according to an arbitrary rotational position of the camshaft 16 after initiation of reverse rotation other than the exhaust top dead center. In addition, the initial reverse rotation angle Ar may be an angle larger than the preset rotational angle Ad and stored in the memory of the electronic control unit C. In this embodiment, the reverse rotation angle is not sensed by the rotational position sensor G, and the rotational sensor may be reduced to improve costs and reduce the number of components.

In addition, the initial reverse rotation angle Ar is set to the angle at which the crankshaft 4 and the camshaft 16 are rotated in the reverse direction even after the decompression cam 40 abuts against the reverse rotation stopper 33. However, it is also possible to provide a sensor, e.g., a contact sensor, for detecting that the decompression cam 40 is abutted against the reverse rotation stopper 33, so that the reverse rotation is terminated when the decompression cam 40 takes the first stop position. In this case, the run-up angle Aa increases in comparison with the approaches of the background art, and the piston can easily overcome the first compression stroke after stoppage of decompression operation.

In the aforementioned embodiment, the effective operation angle A1 of the decompression cam 40 is set at a value larger than the angle of decompression operation A3 of the exhaust cam 32 for opening and closing the exhaust valve 11, and simultaneously smaller than twice the angle of decompression operation A3. However, it is also possible to set the same to the value larger than twice the exhaust cam 32, and in such a case, the run-up angle Aa can further be increased.

Although the starter motor M is an electric starter motor M in the aforementioned embodiment, an electric motor that also serves as a generator may be used at startup. It is also possible that the electric motor can only rotate in the normal operating direction. In this case, a control device is provided with a switching mechanism for switching rotation of the crankshaft 4 from the normal direction to the reverse direction, and vice versa in the rotational force transmission route from the electric motor to the crankshaft 4. Therefore, the crankshaft 4 is rotated in the normal direction or in the reverse direction by the electric motor and the switching mechanism.

Although the engine valve opened by the decompression cam 40 is the exhaust valve 11 in the aforementioned embodiment, it may be the intake valve 10. When providing a sensor for detecting the rotational position of the camshaft 16 in this case, it is preferable to determine the rotational position of the crankshaft 4 at termination of reverse rotation to be near the timing to close the valve of the intake valve, e.g., within the range that the decompression cam 40 does not rotate in the normal direction by the drag torque immediately after initiation of normal rotation of the crankshaft 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A starting method for an internal combustion engine comprising the steps of:

rotating a crankshaft with an electric motor during an engine startup;

opening an engine valve which is opened and closed by a valve train cam by a decompression mechanism, wherein said valve train cam is provided on a camshaft that is rotated synchronously with a rotation of the crankshaft, wherein the decompression mechanism includes a decompression cam provided on the camshaft in such a manner that the decompression cam is capable of rotating in the rotational range of the camshaft between a first stop position of the camshaft in a reverse rotational direction and a second stop position of the camshaft in a normal rotational direction and has a cam profile to bring the engine valve into an opened state at the first stop position and into a closed state at the second stop position;

rotating the crankshaft in the reverse direction with the electric motor to rotate the decompression cam in the reverse direction to place the decompression cam in the first stop position at startup;

rotating the crankshaft in the normal rotational direction with the electric motor to rotate the decompression cam in the normal rotational direction; and opening the engine valve by the decompression cam during either a compression stroke included within the range of a prescribed crank angle in which the crankshaft is rotated in the reverse direction by the electric motor or included within the range within a first compression stroke after a start of normal rotation of the decompression cam, or during the time period until the decompression cam reaches the second stop position.

2. The starting method for an internal combustion engine according to claim 1, further comprising further rotating the crankshaft in the reverse rotational direction with the electric motor after the decompression cam is placed in the first stop position.

3. A starting method for an internal combustion engine comprising the steps of:

rotating a crankshaft with an electric motor during an engine startup;

opening an engine valve which is opened and closed by a valve train cam by a decompression mechanism, wherein said valve train cam is provided on a camshaft that is rotated synchronously with a rotation of the crankshaft, wherein the decompression mechanism includes a decompression cam provided on the camshaft in such a manner that the decompression cam is capable of rotating in the rotational range of the camshaft between a first stop position of the camshaft in a reverse rotational direction and a second stop position of the camshaft in a normal rotational direction and has a cam profile to bring the engine valve into an opened state at the first stop position and into a closed state at the second stop position;

rotating the crankshaft in the reverse rotational direction with the electric motor to rotate the decompression cam in the reverse direction to place the decompression cam in the first stop position at startup;

rotating the crankshaft in the normal rotational direction with the electric motor to rotate the decompression cam in the normal direction; and opening the engine valve with the decompression cam at a plurality of compression strokes during a period until the decompression cam reaches the second stop position.

4. The starting method for an internal combustion engine according to claim 3, further comprising further rotating the crankshaft in the reverse rotational direction with the electric motor after the decompression cam is placed in the first stop position.

5. A starting device for an internal combustion engine, wherein the starting device includes an electric motor for rotating a crankshaft during an engine startup, an engine valve with a valve train cam, a control device for controlling rotation of the crankshaft with the electric motor, and a decompression mechanism for opening the engine valve to be opened and closed by the valve train cam provided on a camshaft that is rotated synchronously with rotation of the crankshaft, said decompression mechanism comprising:

a reverse rotation stopper defining a first stop position;

a normal rotation stopper defining a second stop position;

a decompression cam rotatably mounted on the camshaft so as to be capable of rotating in a rotational range of the camshaft between the first stop position in a reverse rotational direction of the camshaft and the second stop position in a normal rotational direction of the camshaft;

a decompression cam profile for opening the engine valve at the first stop position and closing the same at the second stop position;

a torque transmission device transmitting reverse rotation torque from the camshaft to the decompression cam, said torque transmission device including a constrained state in which relative rotation between the camshaft and the decompression cam is constrained during a reverse rotation of the crankshaft, and an unconstrained state in which a drag torque is transmitted in the normal direction from the camshaft to the decompression cam by permitting a relative rotation between the camshaft and the decompression cam during a normal rotation of the crankshaft; and a rotation control device alternately preventing and permitting dragging of the decompression cam between the first stop position and the second stop position in the normal rotational direction.

6. The starting device for an internal combustion engine according to claim 5, wherein torque transmission device includes a one-way clutch and a torque limiter provided in series in a torque transmission route between the camshaft to the decompression cam.

7. The starting device for an internal combustion engine according to claim 6, wherein the one-way clutch controls the constrained state when the crankshaft is rotated in the reverse direction and the unconstrained state when the crankshaft rotates in the normal direction so that the drag torque is transmitted from the camshaft to the decompression cam.

8. The starting device for an internal combustion engine according to claim 6, said torque limiter limiting a reverse rotation torque transmitted from the camshaft to the decompression cam that is at the first stop position to a value below an upper limit torque.

9. The starting device for an internal combustion engine according to claim 7, said torque limiter limiting a reverse rotation torque transmitted from the camshaft to the decompression cam that is at the first stop position to a value below an upper limit torque.

10. The starting device for an internal combustion engine according to claim 9, said torque limiter rotating only the camshaft in the reverse direction when reverse rotation torque exceeds the upper limit torque exerted to the camshaft.

11. The starting device for an internal combustion engine according to claim 6, wherein the electric motor places the decompression cam at the first stop position and then further rotates the crankshaft in the reverse direction.

12. The starting device for an internal combustion engine according to claim 10, wherein the electric motor places the decompression cam at the first stop position and then further rotates the crankshaft in the reverse direction.

13. The starting device for an internal combustion engine according to claim 12, wherein the rotation control device allows the decompression cam to travel within a range of the angle of decompression operation of the valve train cam.

14. The starting device for an internal combustion engine according to claim 13, wherein an effective operation angle of the decompression cam is larger than a valve train cam decompression operation angle.

15. The starting device for an internal combustion engine according to claim 6, said one-way clutch further including a cylindrical outer ring fitted on the camshaft so as to be capable of relative rotation and a clutch element, said clutch element further including at least one roller and at least one coil spring on the periphery thereof.

16. The starting device for an internal combustion engine according to claim 15, said outer ring having a smaller diameter portion and a larger diameter portion, wherein said larger diameter portion has an inner peripheral surface and a plurality of cam grooves formed on the inner peripheral surface and each having a depth that decreases toward the direction of reverse rotation.

17. The starting device for an internal combustion engine according to claim 14, said one-way clutch further including a cylindrical outer ring fitted on the camshaft so as to be capable of relative rotation and a clutch element, said clutch element further including at least one roller and at least one coil spring on the periphery thereof.

18. The starting device for an internal combustion engine according to claim 17, said outer ring having a smaller diameter portion and a larger diameter portion, wherein said larger diameter portion has an inner peripheral surface and a plurality of cam grooves formed on the inner peripheral surface and each having a depth that decreases toward the direction of reverse rotation.

* * * * *